US005429391A

United States Patent [19]

White, II

[11] Patent Number: 5,429,391

[45] Date of Patent: Jul. 4, 1995

[54] OWNERSHIP VERIFICATION OF A PUBLICATION

[76] Inventor: Locke White, II, 501 8th St., Radford, Va. 24141

[21] Appl. No.: 124,022

[22] Filed: Sep. 21, 1993

[51] Int. Cl.[6] ..... B42D 15/00

[52] U.S. Cl. ..... 283/70; 283/901

[58] Field of Search ..... 283/70, 117, 901, 67, 283/74, 77; 281/42; 402/3

[56] References Cited

U.S. PATENT DOCUMENTS

| | | | |
|---|---|---|---|
| 2,282,939 | 5/1942 | Clawson | 281/42 |
| 2,510,053 | 6/1950 | Pfeiffer | 281/42 |
| 5,190,316 | 3/1993 | Hetty | 283/67 X |

*Primary Examiner*—Timothy V. Eley
*Assistant Examiner*—Khan V. Nguyen
*Attorney, Agent, or Firm*—Rodger H. Flagg

[57] ABSTRACT

A method and apparatus for verifying the current ownership of a used publication. A first sticker with indicia for identifying the current ownership verification is adhered with permanent adhesive to a portion of the front cover of the publication. A second transparent sticker is adhered with permanent adhesive to a selected page of text of the publication. A portion of the second transparent sticker extends above the selected page of text so that a tab may be adhered to extend above the selected page of text. Indicia providing identification relating to the current owner of the publication is placed beneath the second transparent sticker. A first photo of the current owner may be placed below the second transparent sticker, and a third transparent sticker is secured with permanent adhesive over at least a portion of the indicia providing identification relating to the current owner of the publication. Indicia may be placed on the second sticker for instruction in the use of the current ownership verification means, and for a suitable warning that current ownership will be verified at the time of resale. An inked stamp may be used on a plurality of edges of the publication, to identify that this publication is protected by current ownership verification. The indicia used to verify that the current ownership of the publication is compared with identification in the possession of the current owner.

23 Claims, 5 Drawing Sheets

OWNERSHIP VERIFICATION OF A PUBLICATION

BACKGROUND OF THE INVENTION

An ownership verification method and apparatus are disclosed, for identifying the current owner of a publication, such as a textbook, prior to resale of the publication.

Textbooks, and other printed publications, are often used for instruction, education, etc. Upon completion of the course of instruction, these publications are often resold to other students, who will be taking a similar course the following semester. The sale, and resale of printed publications, takes place in bookstores, and schools nationwide.

Currently, there is no readily visible way to verify the current ownership of a publication, prior to resale. The student rarely keeps the sales slip from semester to semester, and many bookstore sales slips do not sufficiently disclose the title or author of a publication, so that ownership verification can be properly established, at the time of resale of the publication to the bookstore.

Consequently, many used textbooks are stolen, and sold to a bookstore, prior to resale to another student. Due to the expense of textbooks and other publications, many students count on the resale of their used textbooks and other printed publications, to supplement a portion of the purchase price of the new textbooks and printed publications required in subsequent semesters. The current ease of resale of used textbooks, encourages their theft.

SUMMARY OF THE INVENTION

The present invention provides a means to identify the current owner of a printed publication, prior to the re-purchase of the used publication, for subsequent resale.

A first sticker is permanently secured to the cover, or outside of a printed publication, and serves as a warning to potential thieves, that this printed publication is protected by a means of identifying the current owner of the publication. A stamp having indicia identifying the security system may also be used to mark the edge portions of a plurality of pages of the publication.

A second substantially transparent sticker is then permanently secured to a selected page of text of the publication, such as the first page of the first chapter of text. The second sticker is placed directly over a portion of the text, so that attempted removal will destroy the page of text. Information regarding the use of the security system is preferably printed on the second transparent sticker. The current owner of the publication enters identification, such as name, social security number, school term, etc. below the second transparent sticker. Preferably, a photo of the current owner is also secured below the second transparent sticker, and a third transparent sticker is secured over the identification and the photo of the current owner.

Any attempt to remove the second or third transparent sticker will permanently damage the selected page of text, which will alert the potential purchaser of the publication, such as the bookstore intending to purchase the used publication, and will strongly discourage subsequent resale of the publication. The potential seller will not be able to resell a publication with part of a page, such as the first page of the first chapter, missing.

Thus, the potential purchaser will be discouraged from buying the book, for subsequent resale to other students.

The second sticker is preferably positioned to extend beyond an edge of the selected page of text, so that a suitable tab may be secured to the backside of the second sticker, where the second sticker extends beyond the page of text. The tab serves as further identification of the means of current ownership identification, and provides quick access to the selected page of text.

The second sticker is substantially transparent to allow the selected page of text to be read through the permanently secured second sticker. The second sticker may also provide a warning not to remove the sticker from the selected page. The second sticker may also provide instructions for its installation and use. A plurality of identification spaces are preferably provided below the second sticker, for marking the identification of the current owner, such as name, social security number, school term, student identification number, current year of the current owner of the publication, etc. A photo of the current owner is also preferably secured in proximity below one of the plurality of identification spaces, to aid in identification of the current owner.

A third transparent sticker is then permanently secured over the indicia marked in one of the plurality of identification spaces. The third transparent sticker is sized to also extend over the photo of the current owner of the publication. The third transparent sticker serves to protect the marked indicia and the photo, against removal, forgery, etc. The marked indicia and the photo thus enables the potential purchaser a means of verification of the current ownership of the printed publication, prior to purchasing the publication for resale.

A tab extending above the selected page of text serves to further identify the printed publication as being protected by the means of current ownership identification. The tab further allows the potential purchaser, such as the bookstore personnel, quick access to the selected page when inspecting the used publication prior to purchasing the publication for resale.

A partial photo may be entered next to the photo secured below the second transparent sticker, and covered with a fourth sticker, which may include indicia indicating that the current ownership of the publication has been voided, in order to enable the used publication to be resold.

The above mentioned and other features and objects of this invention and the manner of attaining them will become more apparent and the invention itself will be best understood by reference to the following description of the invention, taken in conjunction with the accompanying drawings.

DESCRIPTION OF THE PREFERRED EMBODIMENT OF THE INVENTION

Figure 1:
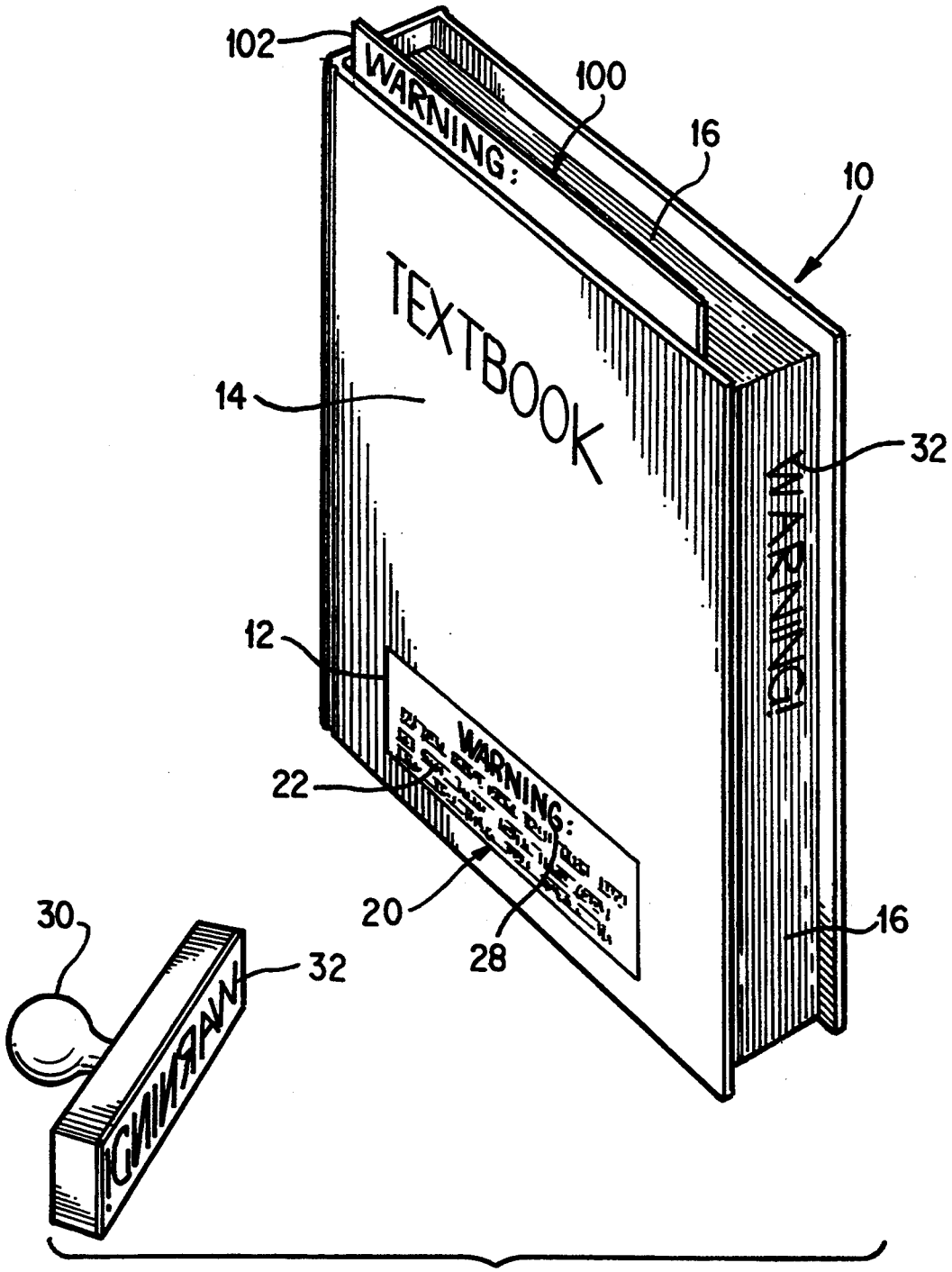
FIG. 1 is a perspective view of a printed publication, showing the first sticker permanently secured to the cover of the publication, the tab extending above the edge of the selected page of text, and indicia stamped on the closed edge portions of the pages of the text, identifying the means of current ownership identification employed.

A printed publication 10, such as the textbook shown in FIG. 1, is protected against theft by identifying the printed publication 10 as being protected by a means of current ownership identification 12. If a textbook or other printed publication 10 cannot be easily resold, the value to the thief is negligible, and the likelihood of theft of the publication is thus greatly reduced.

Figure 3B:
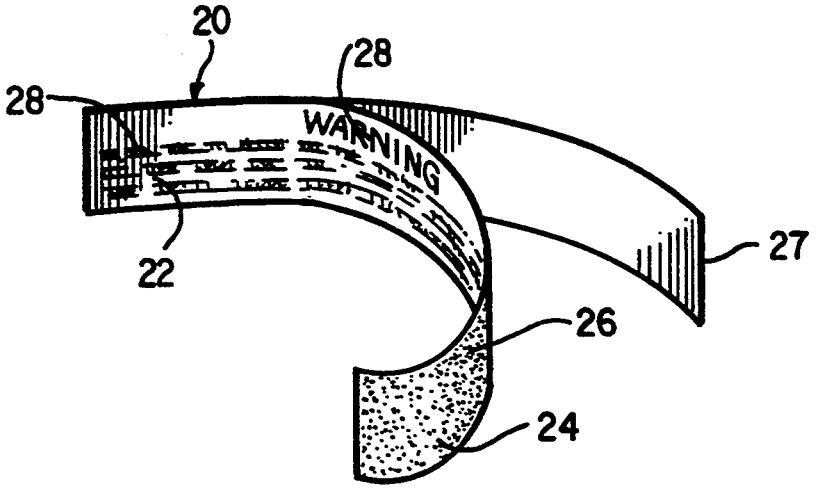
FIGS. 3A and 3B are enlarged views of the first sticker, with a sample warning provided thereon.
Figure 3A:
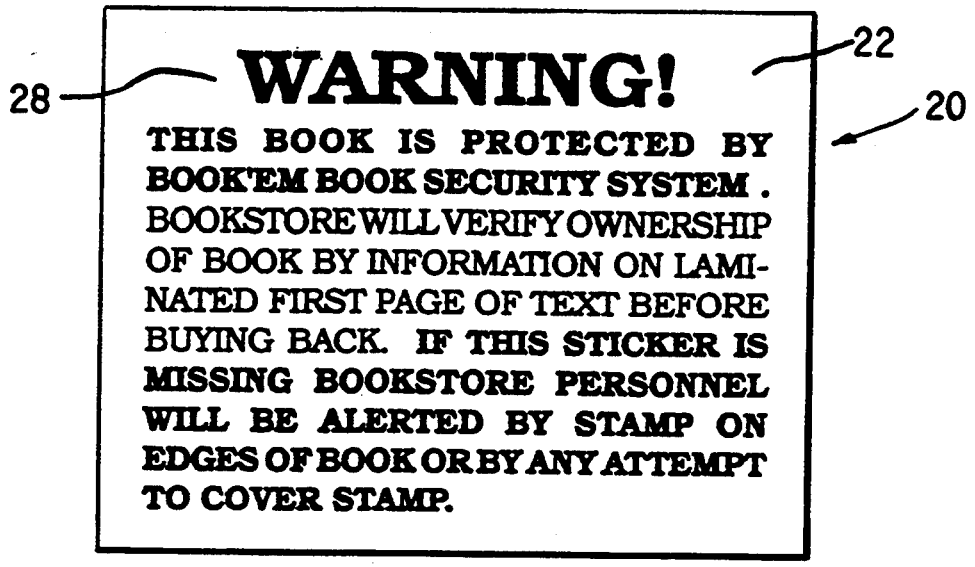

A first sticker 20 having a front side 22 and a back side 24, is secured with a suitable permanent adhesive 26 to the outer cover 14 of the printed publication 10. Indicia 28 visible on the front side of the first sticker 20, serves to identify the printed publication as being protected by the current ownership identification means 12. See FIG. 3A and FIG. 3B.

The permanent adhesive 26 is preferably applied to the back side 24 of the first sticker 20 prior to use, and may be protected by a suitable temporary covering 27, which is removed just prior to applying the first sticker 20 to the outer cover 14 of the publication 10. Other known means of adhesively applying a sticker 20 to an outer cover 14 may also be employed without departing from this disclosure, or the scope of this invention.

For example, permanent adhesives 26 may be heat, light, pressure, sonic, friction or solution, etc. activated, eliminating the need for a suitable temporary covering 27 over the adhesive 26 prior to installation.

A stamp 30 having indicia thereon 32 identifying the means of current ownership identification 12 may be used to stamp the edges 16 of the plurality of pages 18 of the publication 10, as a further means of current ownership identification 12.

Figure 2:
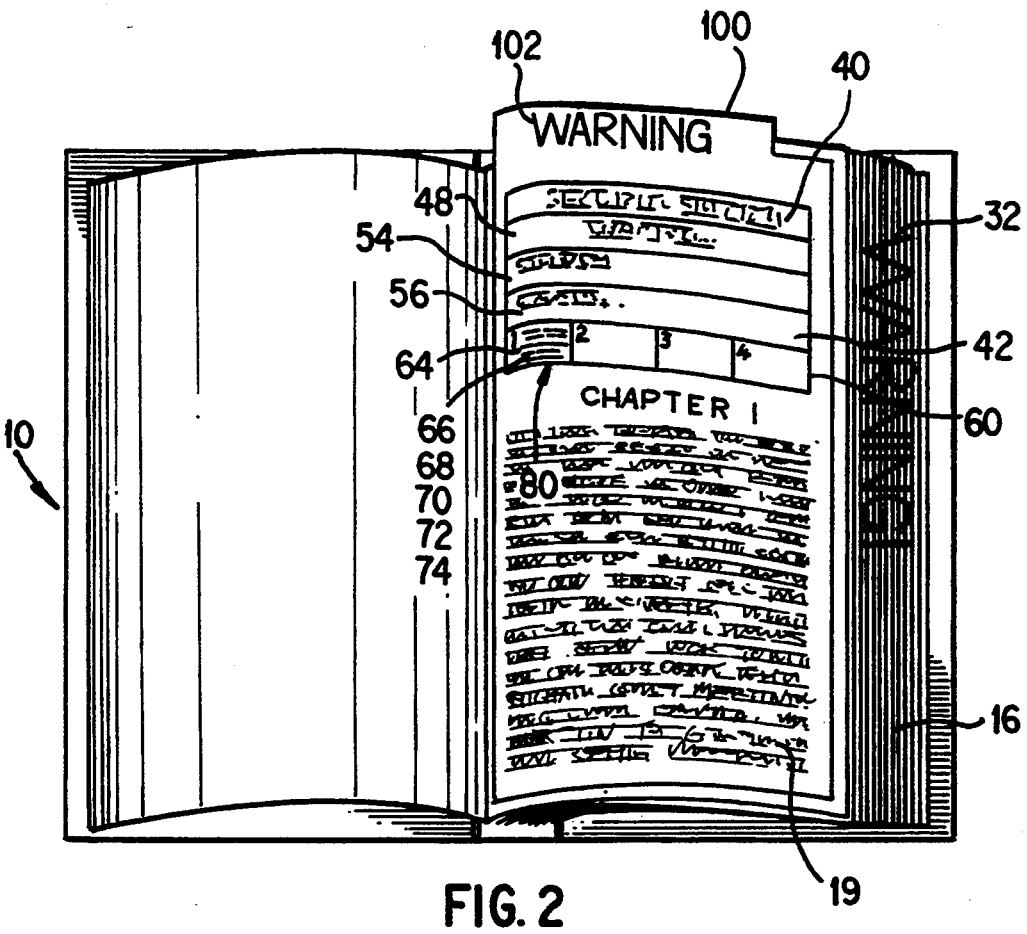
FIG. 2 is an enlarged view of the selected page of text, showing the second sticker permanently installed thereon, with indicia identifying the current owner of the publication located beneath the second sticker.

A second substantially transparent sticker 40, having a front side 42, and a back side 44, is permanently secured to a selected page of text 19 by a suitable adhesive 46, as shown in FIG. 2. The selected page of text 19, for example, may be the first page of the first chapter of the publication 10. The adhesive 46 may be adhered to the back side 44 of the second sticker 40 prior to use, as best shown in FIG. 4B.

As previously noted, any known suitable adhesive 46 may be used to permanently secure the second sticker 40 to the selected page of text 19, including adhesives 46 which are actuated by heat, light, pressure, friction, sonic or chemical solutions, etc. Alternately, a temporary protective cover 47 may be used to protect the adhesive 46 prior to use. The temporary protective cover 47, if used, may be removed just prior to installation to protect the adhesive 46 on the back side 44 of the second sticker 40 during shipping, handling, etc.

Figure 4A:
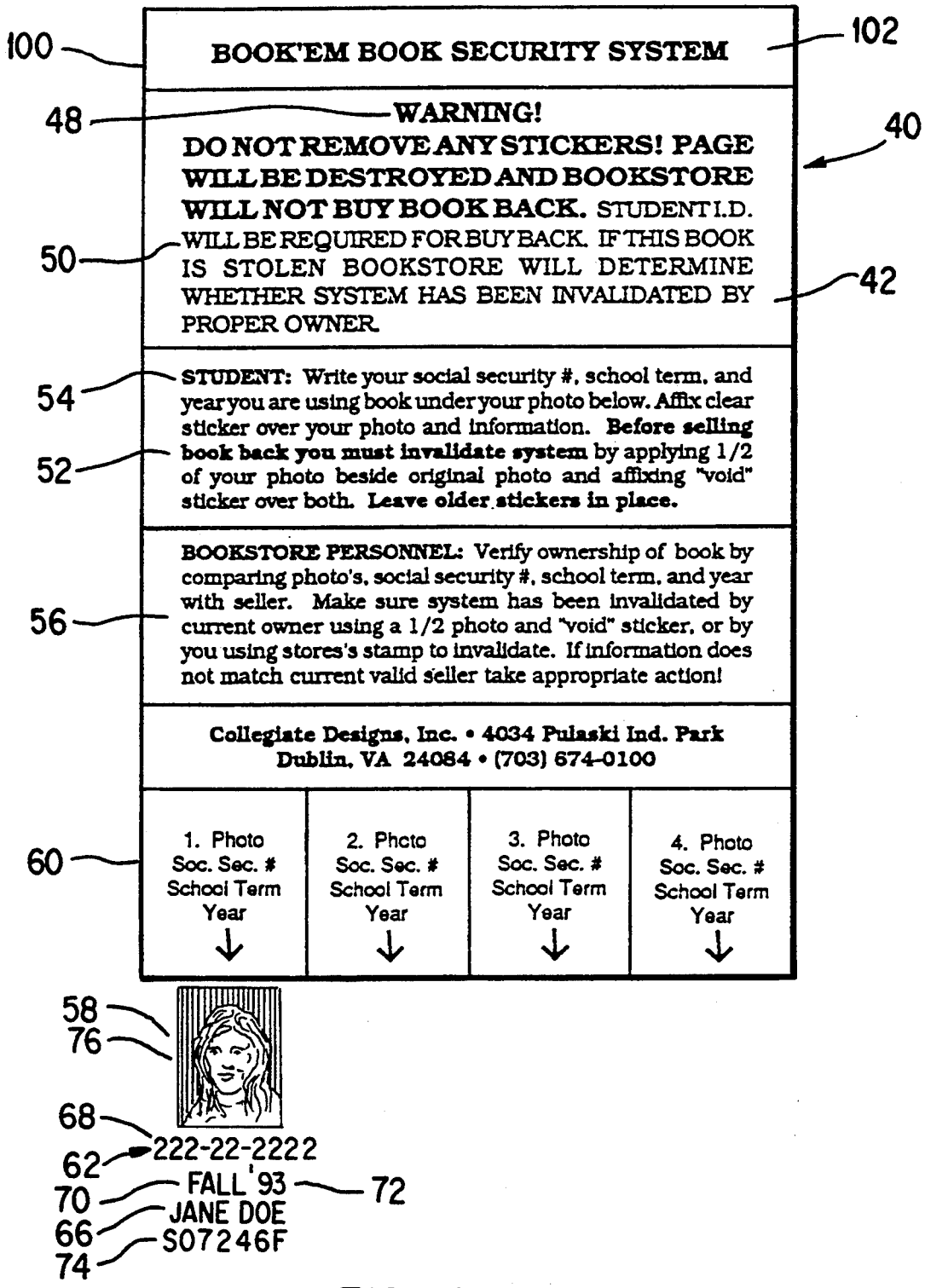
FIGS. 4A and 4B are enlarged views of the second sticker, showing a sample warning and sample instructions, provided thereon.
Figure 4B:
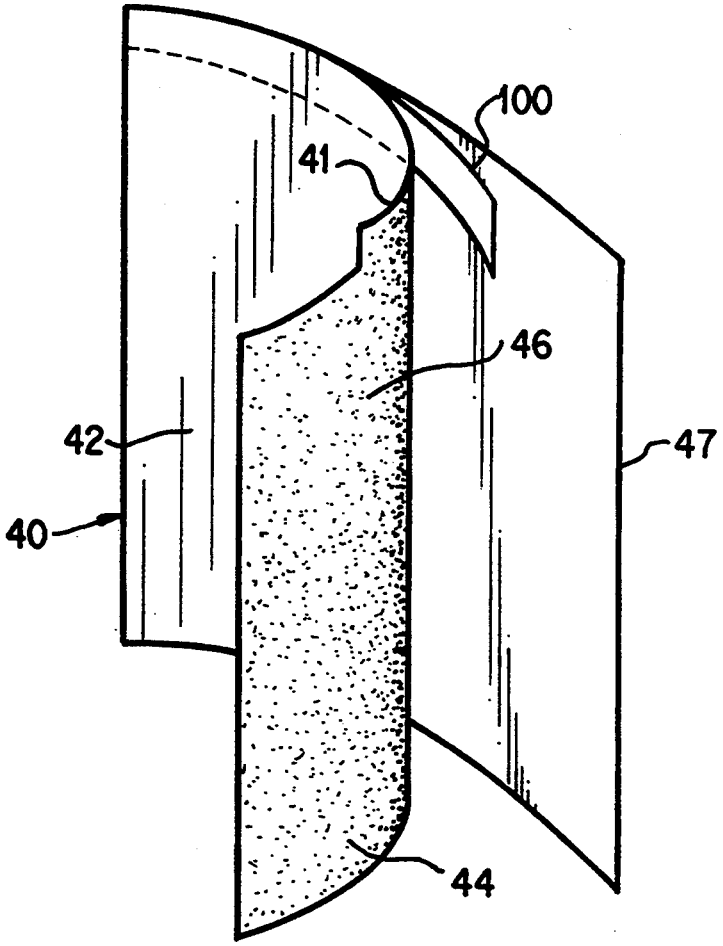

As shown in FIG. 4A, the second sticker 40 may include a warning 48, advising that removal of the second sticker will destroy the selected page of text 19 on which the second sticker 40 has been secured.

The second sticker 40 may also include instructions 50 identifying the procedure for using the means of current ownership identification 12. These instructions 50 preferably include instructions for the installation 52 of the means of current ownership verification, as well as instructions 54 for the identification of the current owner 58 of the publication 10, and instructions 56 for verification of the current ownership of the publication by the intended purchaser of the printed publication 10.

A plurality of ownership identification indicia 60 may be inserted by the current owner 58 of the publication 10 below the second sticker 40. The current owner 58 of the publication 10, marks indicia 62 identifying the current ownership 58 of the publication 10 directly onto the selected page of text 19 at a location beneath the second sticker 40. The selected ownership indicia 62 identifying the current ownership 58 of the publication 10 can be easily verified at a later time of resale of the publication 10. One such indicia 62 may be the current owner's name 66. Another useful indicia may be the current owner's social security number 68. Yet another useful indicia 70 may be the school term, such as (SPRING) or (FALL). Still another useful indicia 62 may be the Year 72 in which the publication 10 is used, such as (94').

Another useful indicia 62 may be the student's school identification number 74. Yet another useful indicia 62 is a first photograph 76 of the current owner 58 of the publication 10.

The selected indicia 62 should be specific enough to easily identify the current owner 58, with suitable documentation (not shown) carried by the current owner 58 at the time of sale. Such documentation may be the seller's drivers license, student identification, photographic likeness, etc.

If the documentation carried by the seller does not correspond with the current ownership 58 indicia 62 provided beneath the second sticker 40, then the potential purchaser (not shown) should take appropriate action.

Figure 5A:
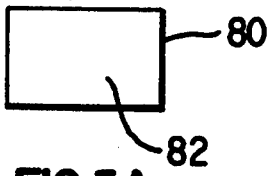
FIGS. 5A and 5B are enlarged views of the third sticker used to cover the photo of the current owner and the indicia marked in one of the identification spaces provided on the second sticker.
Figure 5B:
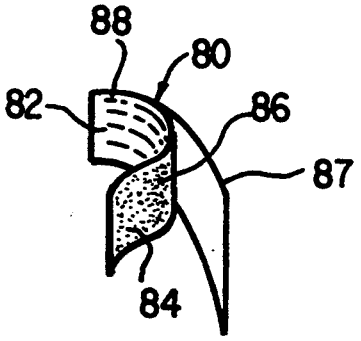
Figure 6:
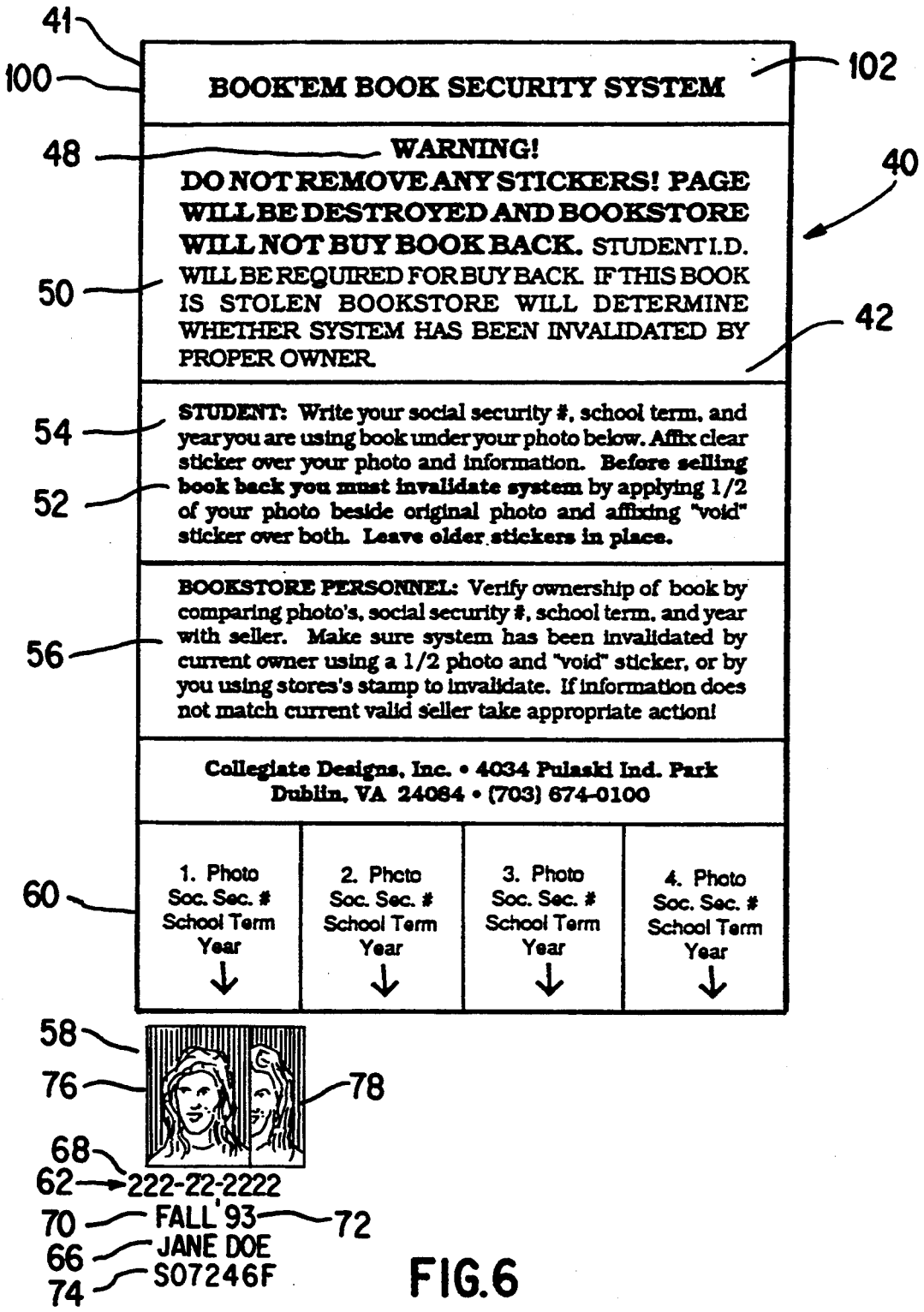
FIG. 6 is an enlarged view of the fourth sticker used to void the current ownership of the used publication prior to resale of the publication.

As shown in FIG. 5A and FIG. 5B, a third substantially transparent sticker 80, having a front side 82 and a back side 84, with permanent adhesive 86 secured to the back side 84, is secured over at least a portion of the indicia 62 used to identify the current ownership 58 of the publication 10, including the first photo 76, if used, to protect the ownership identification indicia 62 marked thereon, from being tampered with or removed, without destroying a portion the second and third stickers 40, 80, or a portion of the selected page of text 19.

When the current owner 58 of the publication 10, wishes to resell the publication 10, at least a portion of a second photo 78 of the current owner 58 may be placed next to the first photo 76. The first and second photo's 76, 78 may then be at least partially covered with a fourth sticker 90. Indicia 92 on the fourth sticker 90 indicating that the indicia relating to current ownership 58 of the publication 10 has been cancelled or voided, may be included on the fourth sticker 90.

The method for using the apparatus disclosed herein, is as follows:

The current owner 58, such as a college student, wishing to protect their current ownership of a publication 10, such as a textbook, purchases the means for current ownership identification 12, and applies the first sticker 20 to the outer cover 14 of the publication 10, to identify the means of current ownership identification 12, and to warn potential thieves that this publication 10 is protected. This can be done at the time of purchase of the publication 10, or at any later time, prior to resale of the publication 10. The first sticker 20 serves as a warning to any potential thief, that the current ownership identification 12 is supplied on a selected page of text 19 within the publication 10.

Next, the current owner 58 selects a page of text 19, such as the first page of text of the first chapter of the publication 10, and secures the second sticker 40 thereon with the adhesive 46 provided. The second sticker 40 is preferably located on the selected page of text 19, so that a portion 41 of the second sticker 40 extends beyond the edge of the selected page of text 19.

A suitable tab 100 is then secured to the adhesive portion 46 of the back side 44 of the second sticker 40 which extends beyond the edge of the selected page of text 19. The tab 100 may have indicia thereon 102, to identify the means of current ownership identification 12 used. The tab 100 also provides an easy means of opening the publication to the selected page of text 19, to speed verification of current ownership indicia 64 at the time of resale.

The current owner 58 then marks selected indicia 64 with suitable identification ownership identification means 62, such as the current owner's name 66, social security number 68, school term 70, school year 72, student identification number 74, a first photograph 76, etc. This is preferably done with a permanent marker, such as a pen (not shown).

Once the selected ownership identification indicia 64 has been filled in beneath the second sticker 40, a third sticker 80 is secured by permanent adhesive 86 over at least a portion of the selected ownership indicia 62 and the first photo 76 (when used), to protect the current ownership identification indicia 62 and the first photo 76 from removal, or from tampering, etc.

The publication 10 is now protected, or "ARMED" by the means for current ownership identification 12 disclosed herein.

When the used publication 10 is returned to the bookstore, school, etc. for resale, the bookstore personnel may readily identify the publication 10 as one protected by the means for current ownership identification 12.

The first sticker 20 is visible on the outer cover 14 of the publication 10. Should an attempt be made to remove the first sticker 20 from the outer cover 14 of the publication 10, the permanent adhesive 26 will damage the outer cover 14 to the extent that the damage is easily visible to the potential purchaser.

Other identification means may also be used, such as providing a tab 100 which extends beyond the edge of the selected page of text 19. A stamp 30 may also be used, to mark indicia 32 on a plurality of edges 16 of the pages of text 18, for ease of identification of the means of current ownership identification 2 used.

The first sticker 20, stamped indicia 32 and tab 100, each serve as a warning to potential thieves, that this publication 10 is protected, and thus, the likelihood of resale is negligible. This serves to discourage the theft of the publication 10 thus marked.

Should anyone other than the current owner of the publication attempt to sell the publication 10 for subsequent resale, the bookstore personnel are able to readily compare the seller's identification via driver's license, social security number or student identification, or photographic likeness with the current ownership indicia 62 located below the second sticker 40.

Any attempt to modify, tamper with, or destroy the current ownership indicia 62, or the first photo 74 located beneath the third sticker 80 and held in place by a suitable permanent adhesive 86, will result in obvious damage to at least one of the second and third sticker 40, 80, or to the selected page of text 19. If the current ownership identification 60 does not match up, or shows signs of tampering, the bookstore personnel can take further steps to verify the ownership of the publication 10.

If the previous school term 70 and year 72 are indicated in the ownership indicia 62 located beneath the third sticker 80, then current ownership identification 12 should be checked with the identification provided by the seller of the previously used publication 10. If the previous school term 70 and year 72 are not indicated, or are not current, or the current ownership identification 60 has been voided, or "DISARMED" with the fourth sticker 90, then it can be assumed that the means for current ownership identification 62 is no longer active or valid, and the publication 10 may be purchased from the seller, without further comparison of the indicia 62 with the personal identification provided by the seller.

In the event the selected page of text 19 has been entirely removed with the second sticker 40, the bookstore personnel may assume the book has been stolen, and refuse to purchase the book or publication 10. Since the second sticker 40 is preferably placed over a selected page of text 19, its removal would seriously damage the publication 10, and render the damaged publication 10 without further value.

At least a portion of a second photo 78 may be secured adjacent to the first photo 76 to serve as a means of cancelling the current ownership indicia 62. The fourth sticker 90 may then be secured at least partially over the current ownership indicia 62. The fourth sticker 90 preferably has indicia 92 thereon cancelling the ownership identifying indicia 62 located at least partially beneath the fourth sticker 90.

Should the current ownership identification 60 match with the personal identification carried by the current seller of the publication 10, the bookstore personnel may be assured of proper ownership of the publication 10, and may proceed to purchase the publication 10 from the current owner 58 of the publication 10.

The first, second, third and fourth stickers 20, 40, 80, 90 remain in place on the publication 10 for its lifetime of use. As subsequent students' purchase the publication 10 protected by this means of current ownership identification 12, they may elect to fill in their ownership identification indicia 62 below the second sticker 40.

Should the current owner elect to leave subsequent selected ownership identification indicia 62 blank, it will have no effect when they wish to resell their publication 10, as the previous school term 70 and year 72 will be left blank, and no current ownership verification will be required by the bookstore personnel.

Thus, the means of current ownership identification 12 disclosed herein, provides a way to discourage theft of used textbooks or other publications 10 from their fellow students, while providing the bookstore personnel with a prompt means of comparison of the current ownership information 60 provided on the second sticker 40 with the ownership identification indicia 62 provided by the seller to assure current ownership of the publication 10 prior to resale.

The first, second, third and fourth stickers, 20, 40, 80, 90; tab 100 and stamp 30 disclosed herein may be inexpensively manufactured, easily transported and stored, and may be supplied in kit form to the current owner 60, for subsequent installation in the book or publication 10 which they wish to protect.

Alternately, the fourth sticker 90 may be supplied only to authorized bookstore personnel selling the current ownership identification means 10, and used exclusively by authorized personnel to cancel or void the current ownership identification indicia 62, upon proper verification of ownership, at the time of purchasing the publication 10.

Thus, while the means of ownership verification of a publication 10 disclosed herein has been fully described and disclosed, numerous modifications will become apparent to one of ordinary skill in this art, and such adaptations and modifications are intended to be included within the scope of the following claims.

What is claimed is:

1. A method of verifying the current ownership of a used publication having an outer cover and a plurality of pages of text, each page having a front side, a back side, a top edge, a bottom edge, a bound edge and a front edge, which comprises:

a) adhesively adhering a first sticker to a portion of the outer cover of the publication; the first sticker having indicia thereon visible for identifying the means of current ownership verification provided therein;

b) adhesively adhering a second substantially transparent sticker to a selected page of the text of the publication, and positioning a portion of the second transparent sticker to extend beyond the top edge of the selected page of text;

c) adhesively adhering a tab to at least a portion of the second transparent sticker which extends beyond the top edge of the selected page of text;

d) marking indicia beneath the second transparent sticker to provide identification relating to the current owner of the publication;

e) securing a first photo of the current owner in proximity to the indicia marked below the second transparent sticker;

f) and adhesively adhering a third transparent sticker over at least a portion of the marked indicia used for identification on the current owner of the publication, the third transparent sticker further extending over at least a portion of the first photo of the current owner of the publication.

2. The method of claim 1, wherein the method further comprises providing indicia visible on the second transparent sticker for instruction in the use of the current ownership verification means.

3. The method of claim 1, wherein the method further comprises providing indicia visible on the second transparent sticker for instruction in the use of the current ownership verification means.

4. The method of claim 1, wherein the method further comprises providing indicia visible on the second transparent sticker warning that current ownership of this publication will be verified at the time of resale of this publication.

5. The method of claim 1, wherein the method of marking indicia to indicate the current owner of the publication further comprises marking the name of the current owner of the publication below the second transparent sticker, prior to placing the third transparent marker over at least a portion of the marked indicia used to indicate the current owner of the publication.

6. The method of claim 1, wherein the method of marking indicia to indicate the current owner of the publication further comprises marking the social security number of the current owner of the publication below the second transparent sticker, prior to placing the third transparent marker over at least a portion of the marked indicia used to indicate the current owner of the publication.

7. The method of claim 1, wherein the method of marking indicia to indicate the current owner of the publication further comprises marking the current school term and the current school year below the second transparent sticker, prior to placing the third transparent marker over at least a portion of the marked indicia used to indicate the current owner of the publication.

8. The method of claim 1, wherein the method of identifying the current ownership of the publication further comprises securing at least a portion of a second photograph of the current owner adjacent to the first photograph of the current owner as a means of cancelling the current ownership of the publication, prior to resale of the publication.

9. The method of claim 1, wherein the method further comprises marking indicia with an inked stamp across at least one of the top edge, the bottom edge and the front edge of the plurality of pages of text of the publication to identify that this publication is protected by a means of current ownership identification.

10. The method of claim 1, wherein the method further comprises identifying the current owner of the publication by comparing the identification information in the possession of the current owner of the publication with the identification indicia located beneath the second transparent sticker, prior to purchasing the used publication from the current owner.

11. The method of claim 10, wherein the method further comprises adhesively securing a fourth sticker over at least a portion of the indicia identifying the current owner of the publication, the fourth sticker further having indicia thereon cancelling the current owner identification, in preparation for resale of the publication.

12. An ownership verification apparatus used for identifying the current owner of a publication having an outer cover, and a plurality of pages of text, each page having a front side, a back side, a top edge, a bottom edge, a bound edge and a front edge, the ownership verification apparatus comprising:

a) a first sticker for securement to a portion of the outer cover of the publication;

b) a second transparent sticker for adhesive securement to one of the selected pages of the text of the publication, the second transparent sticker positioned to extend beyond the top edge of the selected page of text;

c) a tab secured to at least a portion of the second transparent sticker which extends beyond the top edge of the selected page of text;

d) indicia identifying the current ownership of the publication inserted below the second transparent sticker;

e) a third transparent sticker for adhesive securement over at least a portion of the indicia used to identify the current owner of the publication; and f) a fourth sticker for adhesive securement over at least a portion of the indicia used to identify the current owner of the publication, said fourth sticker having indicia thereon cancelling the current ownership identification in preparation for the resale of the publication.

13. The apparatus of claim 12, wherein the first sticker includes indicia visible for identifying that the publication is protected by a current ownership identification means.

14. The apparatus of claim 12, wherein the first sticker includes indicia visible for identifying that the publication is protected by a current ownership identification means.

15. The apparatus of claim 12, wherein the second transparent sticker includes indicia warning that current ownership identification will be verified at the time of resale of the publication.

16. The apparatus of claim 12, wherein the second transparent sticker extending beyond the top edge of the selected page of text is bent back over the tab to secure the tab between the second transparent sticker, with the back side of the second transparent sticker extending below the top edge of the selected page of text for permanent securement of the second transparent sticker to a portion of the opposite side of the selected page of text.

17. The apparatus of claim 12, wherein the indicia used to identify the current owner of the publication, includes the name of the current owner of the publication, which is marked by the current owner of the publication beneath the second label prior to securing the third transparent sticker over at least a portion of the indicia used to identify the current owner of the publication.

18. The apparatus of claim 12, wherein the indicia used to identify the current owner of the publication includes the social security number of the current owner of the publication, which is marked by the current owner of the publication beneath the second sticker prior to securing the third transparent sticker over at least a portion of the indicia used to identify the current owner of the publication.

19. The apparatus of claim 12, wherein the indicia used to identify the current owner of the publication includes the school term and the current school year of use, which is marked by the current owner of the publication prior to securing the third transparent sticker over at least a portion of the indicia used to identify the current owner of the publication.

20. The apparatus of claim 12, wherein the indicia used to identify the current owner of the publication includes securing a photograph of the current owner beneath the second sticker, prior to securing the third transparent sticker over at least a portion of the photograph used to identify the current owner of the publication.

21. The apparatus of claim 12, wherein an inked stamp is used to imprint indicia on at least one of the top edge, the bottom edge and the front edge of the plurality of pages of text of the publication, to identify that this publication is protected by a means for current ownership identification.

22. The apparatus of claim 12, wherein the current owner of the publication may be identified by comparing identification in the possession of the current owner with the indicia identifying the current owner of the publication located below the second transparent sticker, prior to purchasing the publication for resale.

23. The apparatus of claim 20, wherein at least a portion of a second photograph of the current owner of the publication is secured adjacent to the first photograph of the current owner of the publication, as a means of cancelling the current ownership of the publication prior to resale of the publication.

* * * * *